US007650098B2

(12) United States Patent
Murayama

(10) Patent No.: US 7,650,098 B2
(45) Date of Patent: Jan. 19, 2010

(54) IMAGE FORMING APPARATUS HAVING A PLURALITY OF PHOTOSENSITIVE DRUMS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 423 days.

(21) Appl. No.: 11/755,081

(22) Filed: May 30, 2007

(65) Prior Publication Data

US 2007/0280729 A1 Dec. 6, 2007

(30) Foreign Application Priority Data

May 31, 2006 (JP) ..... 2006-152617

(51) Int. Cl.
*G03G 15/02* (2006.01)

(52) U.S. Cl. ..... 399/116

(58) Field of Classification Search ..... 399/107, 399/110, 111, 112, 113, 116, 117, 159, 167
See application file for complete search history.

(56) References Cited

U.S. PATENT DOCUMENTS

| | | | | |
|---|---|---|---|---|
| 4,816,844 | A | 3/1989 | Uchida et al. | |
| 6,101,349 | A * | 8/2000 | Ohashi et al. | 399/110 |
| 6,477,346 | B1 | 11/2002 | Yahagi | |
| 7,519,310 | B2 * | 4/2009 | Yamaguchi et al. | 399/111 |

FOREIGN PATENT DOCUMENTS

| | | |
|---|---|---|
| JP | 62-229264 | 10/1987 |
| JP | 62-299977 | 12/1987 |
| JP | 63-301065 | 12/1988 |
| JP | 02-089446 | 7/1990 |
| JP | 04-006063 | 1/1992 |
| JP | 08-087152 | 4/1996 |
| JP | 63-029148 | 2/1998 |
| JP | 63-043173 | 2/1998 |
| JP | 2001-222201 | 9/2007 |

* cited by examiner

*Primary Examiner*—Hoan H Tran
(74) *Attorney, Agent, or Firm*—Banner & Witcoff, Ltd.

(57) ABSTRACT

An image forming apparatus including an outer frame, a photosensitive unit, a drum drive gear, a first positioning portion, and a second positioning portion. The photosensitive unit includes a plurality of photosensitive drums, a first supporting shaft, a second supporting shaft, and a drum gear. Each of the plurality of photosensitive drums has an axis extending in a first direction. The plurality of photosensitive drums is juxtaposed in a second direction perpendicular to the first direction. A position of the first supporting shaft and the second supporting shaft provided on one of the plurality of photosensitive drums in the second direction with respect to the outer frame is determined by contacting the first supporting shaft and the second supporting shaft to the first positioning portion. A position of the two of the first supporting shafts and the two of the second supporting shafts in a third direction perpendicular to both the first direction and the second direction with respect to the outer frame is determined by supporting the two of the first supporting shafts and two of the second supporting shafts on the second supporting portion.

10 Claims, 8 Drawing Sheets

IMAGE FORMING APPARATUS HAVING A PLURALITY OF PHOTOSENSITIVE DRUMS

CROSS REFERENCE TO RELATED APPLICATIONS

This application claims priority from Japanese Patent Application No. 2006-152617 filed May 31, 2006. The entire content of priority application is incorporated herein by reference.

TECHNICAL FIELD

The present invention relates to an image forming apparatus having a plurality of photosensitive drums.

BACKGROUND

There is known a tandem-type color laser printer including a plurality of photosensitive drums and developing rollers corresponding to the colors of yellow, magenta, cyan and black respectively. In the tandem-type color laser printer the toner images of each of the colors are formed substantially concurrently on each of the photosensitive drums by each of the developing rollers, and subsequently, each of the toner images is transferred on a recording paper or an intermediate transfer belt. Thus, a color image can be formed at substantially same speed as a black-and-white laser printer.

Incidentally, in such a tandem-type color printer, the photosensitive drums of each of the colors need to be positioned parallel to one another with accuracy. If the rotating shafts of the photosensitive drums are not parallel to one another, the toner images of the respective colors are displaced from one another, thereby causing color shift.

To prevent this displacement, there is a method of inserting the supporting shafts of the photosensitive drums into supporting holes that are formed accurately in side plates and that has diameters corresponding to the diameters of the supporting shafts. However, in this method, it is difficult that the plurality of photosensitive drums is concurrently inserted into the supporting holes. Therefore, Japanese Patent Application Publications No. 8-87152 and No. 2001-222201 disclose a method that one end portions of the supporting shafts are supported by two side plates. The supporting shafts are positioned in a horizontal direction by one side plate and in a vertical direction by the other side plate.

Moreover, in Japanese Utility Model Application Publication No. 7-36367, springs are provided to push the supporting shafts of the photosensitive drums in one direction, thereby clearing clearances between the supporting shafts of the photosensitive drums and the bearings thereof or gaps between the bearings and the side plates.

SUMMARY

However, the above conventional techniques of positioning the supporting shafts have complicated structures, such as providing the two side plates on one end portions side of the supporting shafts or providing springs for clearing clearances.

In view of the foregoing, it is an object of the present invention to provide an image forming apparatus having simple structure and capable of easily mounting a plurality of photosensitive drums and positioning the photosensitive drums with accuracy.

To achieve the above and other objects, one aspect of the invention provides an image forming apparatus including an outer frame, a photosensitive unit, a drum drive gear, a first positioning portion, and a second positioning portion. The photosensitive unit is disposed in the outer frame. The photosensitive unit includes a plurality of photosensitive drums, a first supporting shaft, a second supporting shaft, and a drum gear. Each of the plurality of photosensitive drums has an axis extending in a first direction, one axial end and another axial end. The plurality of photosensitive drums is juxtaposed in a second direction perpendicular to the first direction. The first supporting shaft is provided on the one axial end of each of the plurality of photosensitive drums. The second supporting shaft is provided on the another axial end of each of the plurality of photosensitive drums. The first support shaft and the second support shaft rotatably support each of the plurality of photosensitive drums. The drum gear is provided on the one axial end of each of the plurality of photosensitive drums and rotatable together with each of the plurality of photosensitive drums. The drum drive gear is rotatably supported on the outer frame and is meshingly engaged with the drum gear to rotate the drum gear. The drum drive gear is configured to apply a pushing force to the drum gear, the photosensitive drum, the first supporting shaft and the second supporting shaft in the second direction when the drum drive gear drives the drum gear. The first positioning portion is provided in the outer frame. The first supporting shaft and the second supporting shaft provided on one of the plurality of photosensitive drums are brought into contact with the first positioning portion by the pushing force. A position of the first supporting shaft and the second supporting shaft provided on the one of the plurality of photosensitive drums in the second direction with respect to the outer frame is determined by contacting the first supporting shaft and the second supporting shaft to the first positioning portion. The second positioning portion is provided in the outer frame and supports two of the first supporting shafts and two of the second supporting shafts provided on two of the plurality of the photosensitive drums. A position of the two of the first supporting shafts and the two of the second supporting shafts in a third direction perpendicular to both the first direction and the second direction with respect to the outer frame is determined by supporting the two of the first supporting shafts and the two of the second supporting shafts on the second supporting portion.

DETAILED DESCRIPTION

Figure 1:
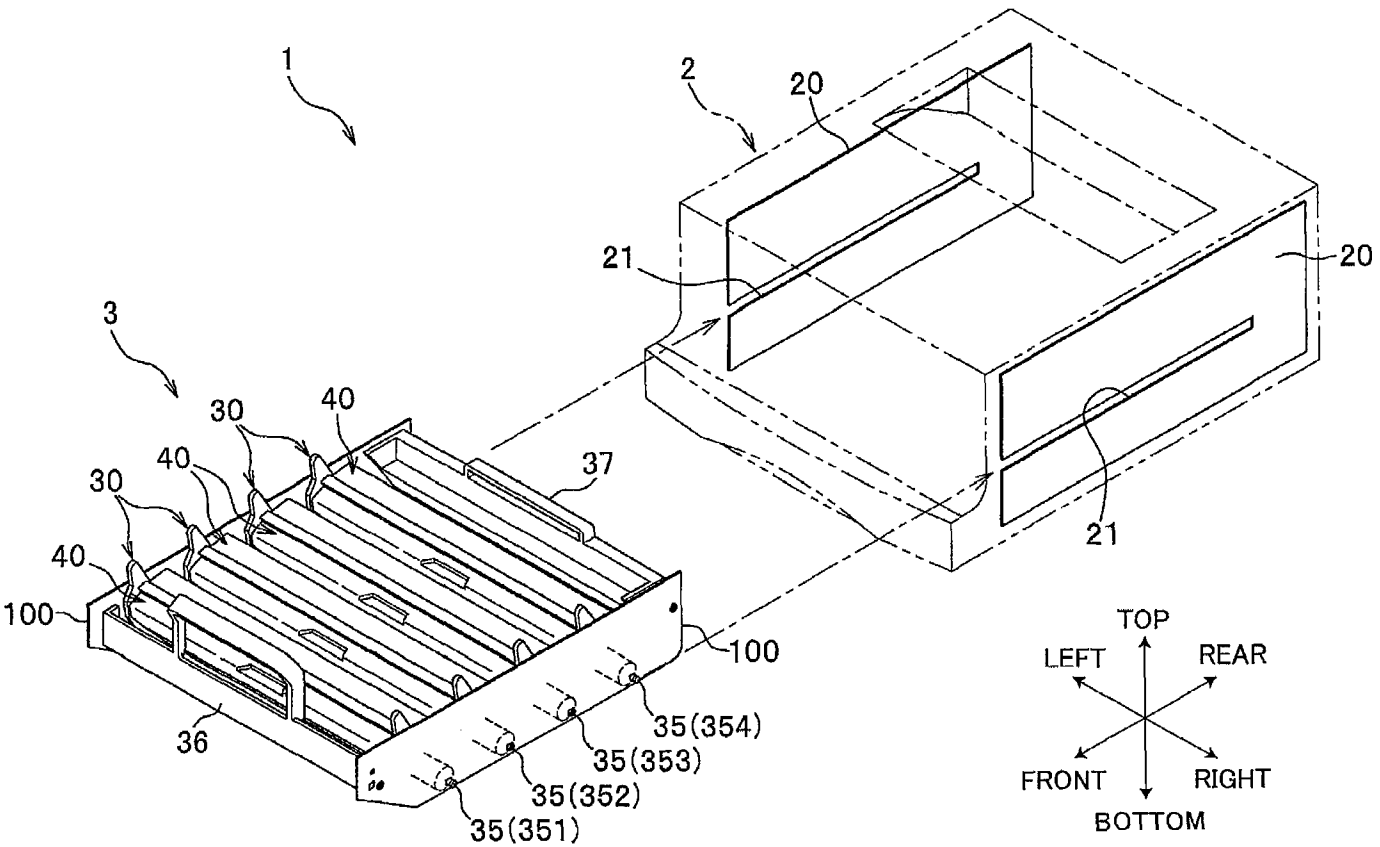
FIG. 1 is a perspective view showing a color laser printer as an example of an image forming apparatus according to the present invention when a drawer-type photosensitive unit has been removed therefrom.
Figure 2:
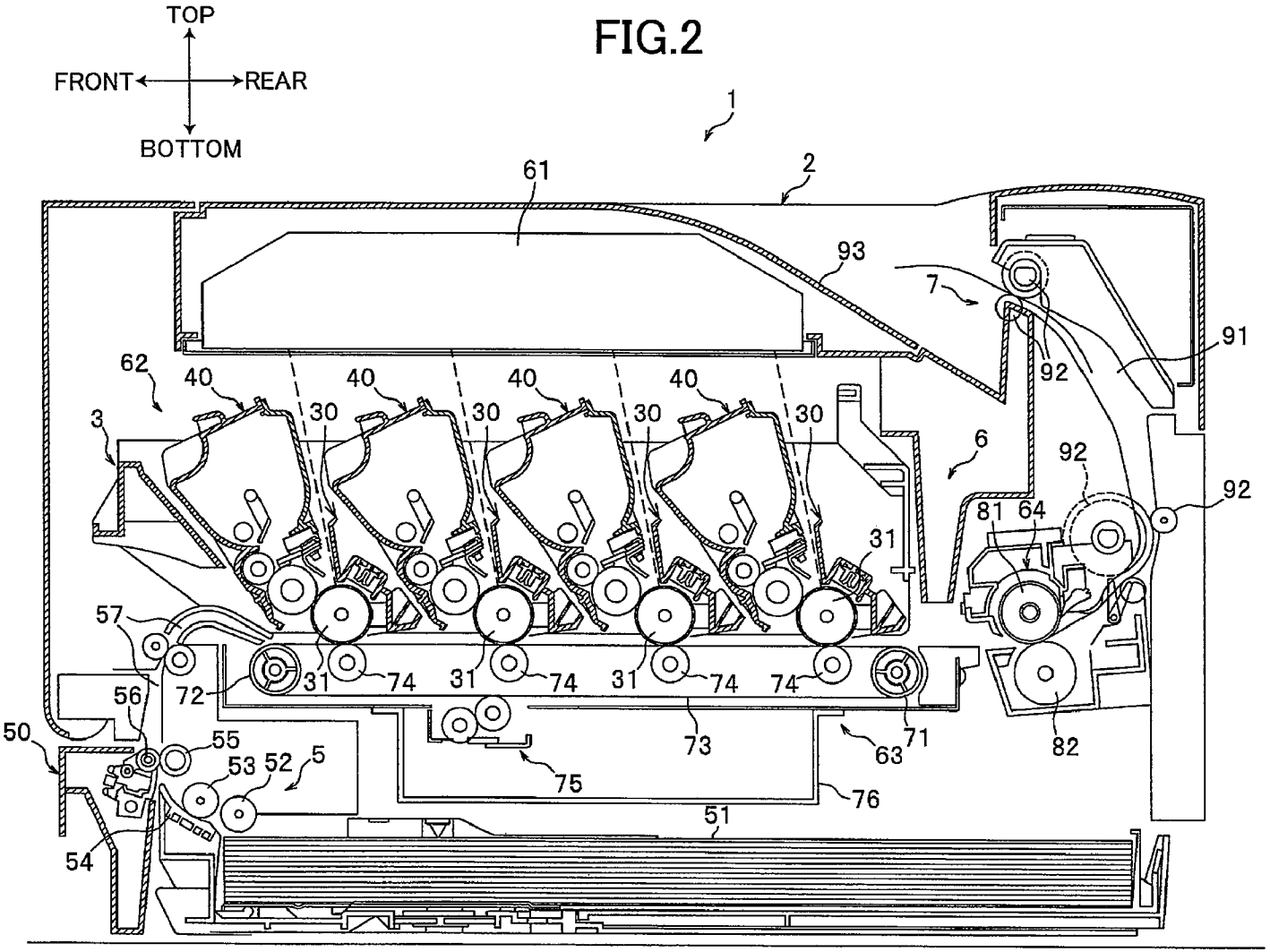
FIG. 2 is a cross-sectional view of primary components of the color laser printer according to the preferred embodiment of the present invention.

Now, the present invention will be described in detail based on a preferred embodiment while referring to the accompanying drawings. FIG. 1 is a perspective view showing a color laser printer 1 according to the present invention, in which a drawer-type photosensitive unit 3 have been removed therefrom. FIG. 2 is a cross-sectional view showing the primary components of the color laser printer 1.

As shown in FIG. 1, the color laser printer 1 includes a main unit 2 and the drawer-type photosensitive unit 3. The photosensitive unit 3 can be removed from the main unit 2 by drawing the photosensitive unit 3 from the main unit 2 and be mounted in the main unit 2 by pushing the photosensitive unit 3 to the main unit 2. A plurality of, for example, four drum sub-units 30 are juxtaposed in a horizontal direction in the photosensitive unit 3. Developing cartridges 40 containing color toners of cyan, magenta, yellow and black are mounted in the predetermined positions of the drum sub-units 30, respectively.

As shown in FIG. 2, the color laser printer 1 also includes a paper feed unit 5, an image forming unit 6 and a paper ejection unit 7 in the main unit 2. The paper feed unit 5 feeds recording papers 51. The image forming unit 6 forms an image on the fed recording paper 51. The paper ejection unit 7 ejects the recording paper 51 on which an image is formed.

In addition, in the description below, the TOP and BOTTOM, LEFT and RIGHT, as well as FRONT and REAR directions shown in FIG. 1 represent the top and bottom, left and right, as well as front and rear directions in the color laser printer 1, unless explicitly stated otherwise.

(1) Paper Feed Unit 5

The paper feed unit 5 is provided on the lowest portion of the main unit 2 and includes a paper feed tray 50 and a paper feeding mechanism. The paper feed tray 50 is detachably provided from the front side of the main unit 2. The paper feeding mechanism picks up the recording paper 51 from the paper feed tray 50 upward in the forward direction and reverses the recording paper 51 rearward. The paper feeding mechanism includes a paper feed roller 52, a separating roller 53 and a separating pad 54 disposed in the front section of the paper feed tray 50. The recording papers 51 are separated and fed one sheet at a time by the paper feed roller 52, the separating roller 53 and the separating pad 54. The recording paper 51 fed upward passes between a dust removing roller 55 and a pinch roller 56. After the dust removing roller 55 removes paper dust from the recording paper 51, the recording paper 51 is turned about backward through a feeding path 57 and is fed on a conveying belt 73.

(2) Image Forming Unit 6

The image forming unit 6 includes a scanning unit 61, a process unit 62, a transfer unit 63 and a fixing unit 64.

[Scanning Unit 61]

The scanning unit 61 is provided in the upper portion of the main unit 2 and includes a laser light source, a polygon mirror, a plurality of lenses and a reflecting mirror, all of which are not shown. Lasers emitted from the laser light source corresponding to each of the colors of cyan, magenta, yellow and black are scanned in the left-to-right direction at high speed by the polygon mirror. These lasers pass through the plurality of lenses and are reflected by the mirror reflector. Subsequently, the lasers are irradiated to the photosensitive drums 31, respectively.

[Process Unit 62]

The process unit 62 is disposed below the scanning unit 61 and above the paper feed unit 5. As described later, the process unit 62 includes a photosensitive unit 3 and developing cartridges 40. Each of the developing cartridges 40 is mounted in one of the drum sub-units 30 of the photosensitive unit 3.

Figure 3:
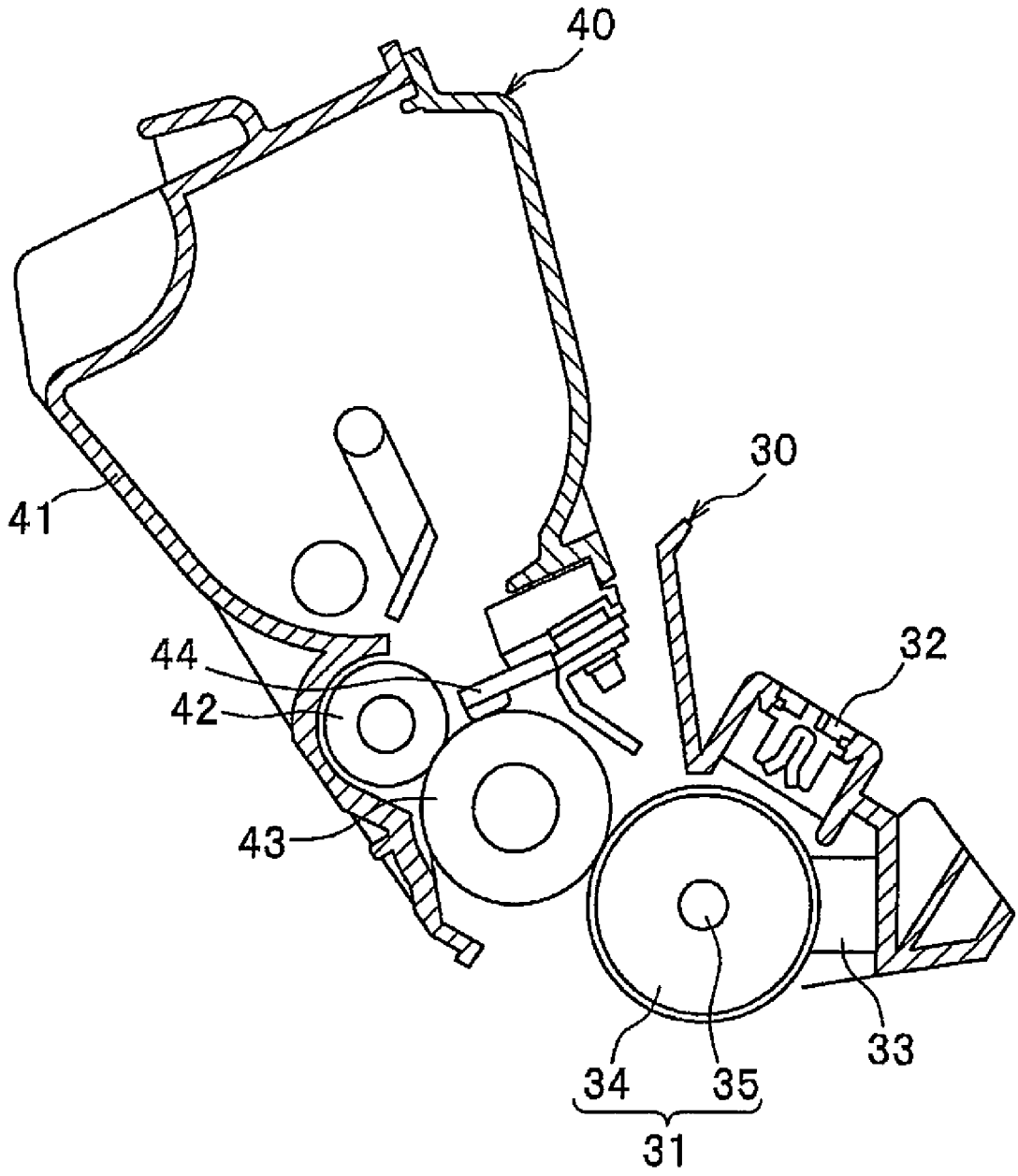
FIG. 3 is a sectional side view illustrating a drum sub-unit and a developing cartridge according to the preferred embodiment of the present invention.

FIG. 3 is a side cross-sectional view illustrating the drum sub-unit 30 and the developing cartridge 40. As shown in FIG. 3, the drum sub-unit 30 includes a photosensitive drum 31, a scorotron-type charger 32 and a cleaning brush 33. The photosensitive drum 31 is disposed along the width direction (the left-to-right direction) of the color laser printer 1. The photosensitive drum 31 is configured of a cylindrical drum main body 34 and supporting shafts 35. The drum main body 34 has a positive charging photosensitive layer formed of polycarbonate on its outer surface. The supporting shafts 35 are coaxial with the drum main body 34 and provided on both ends of the drum main body 34, respectively.

The developing cartridge 40 includes a developing frame 41, a supply roller 42, a developing roller 43 and a thickness regulating blade 44. Toner is accommodated in the developing frame 41. The supply roller 42 and developing roller 43 are provided below the developing frame 41. The feed roller 42 is made of conductive sponge on the surface thereof. The developing roller 43 is made of conductive rubber. The supply roller 42 contacts the developing roller 43 with pressure so that both are compressed. The thickness regulating blade 44 contacts the developing roller 43 with pressure.

The process unit 62 functions as follows: The toner in the developing cartridges 40 is supplied onto the developing roller 43 by the feed roller 42. At this time, the toner is positively tribocharged between the supply roller 42 and the developing roller 43 to which developing bias is applied. As the developing roller 43 rotates, the toner supplied onto the developing roller 43 is smoothed by the thickness regulating blade 44, thereby maintaining a uniform thickness of toner on the surface of the developing roller 43. On the other hand, in the drum sub-unit 30, the scorotron-type charger 32 produces a corona charge in order to form a uniform positive charge over the surface of the photosensitive drum 31. The scanning unit 61 irradiates laser to the charged photosensitive drum 31, thereby forming an electrostatic latent image on the surface of the photosensitive drum 31 corresponding to an image to be formed on the recording paper 51.

Next, positively charged toner carried on the surface of the developing roller 34 comes into contact with the photosensitive drum 31 as the developing roller 34 rotates and is supplied to areas on the surface of the photosensitive drum 31 that were exposed to the laser and, therefore, have a lower potential. In this way, the latent image on the photosensitive drum 31 is transformed into a visible image corresponding to the toners of the respective colors so that a reverse developed toner image is held on the photosensitive drum 31.

[Transfer Unit 63]

As shown in FIG. 2, the transfer unit 63 includes a drive roller 71, a follower roller 72, the conveying belt 73, transfer rollers 74 and a cleaning portion 75. The drive roller 71 and follower roller 72 are disposed parallel to each other in the left-to-right direction with being spaced in the front-to-rear direction. The conveying belt 73 has endless loop shape and is wound around the drive roller 71 and follower roller 72. The conveying belt 73 contacts the photosensitive drums 31 on the outer surface thereof. The transfer rollers 74 are disposed inside the transport belt 73. The transfer rollers 74 and the photosensitive drums 31 pinch the conveying belt 73 therebetween. Transfer bias is applied to the transfer roller 74 from a high voltage circuit board (not shown). The recording paper 51 conveyed by the conveying belt 73 is passed between the photosensitive drum 31 and the transferring roller 74, thereby transferring the toner image on the photosensitive drum 31 to the recording paper 51.

The cleaning portion 75 is disposed below the conveying belt 73 to remove the toner adhered to the conveying belt 73 and drop the removed toner into a toner storage portion 76 disposed below the cleaning portion 75.

[Fixing Unit 64]

The fixing unit 64 is disposed on the downstream side of the paper conveying direction of the transfer unit 63, that is, on the rear side of the main unit 2. The fixing unit 64 includes a heating roller 81 and a pressure roller 82. A halogen lamp (not shown) is provided in the heating roller 81 to heat the surface of the same to a fixing temperature. The pressure roller 82 is disposed below and in opposition to the heating roller 60 and contacts the heating roller 60 with pressure. The toner image on the recording paper 51 is fixed by heat as the recording paper 51 passes between the pressure roller 82 and heating roller 81.

(3) Paper Ejection Unit 7

In the paper ejection unit 7, a feeding path 91 of the recording paper 51 is formed so as to extend upward from the outlet of the fixing unit 64 and turn about forward. A plurality of ejection rollers 92 is provided in the feeding path 91 for ejecting the recording paper 51. A catch tray 93 is formed on the upper surface of the main unit 2 for storing the printed recording paper 51. The catch tray 93 has a suitable concave portion. The recording paper 51 ejected from the feeding path 91 by the ejection rollers 92 is stored in the catch tray 93.

2. Configuration of Photosensitive Unit 3

Figure 4:
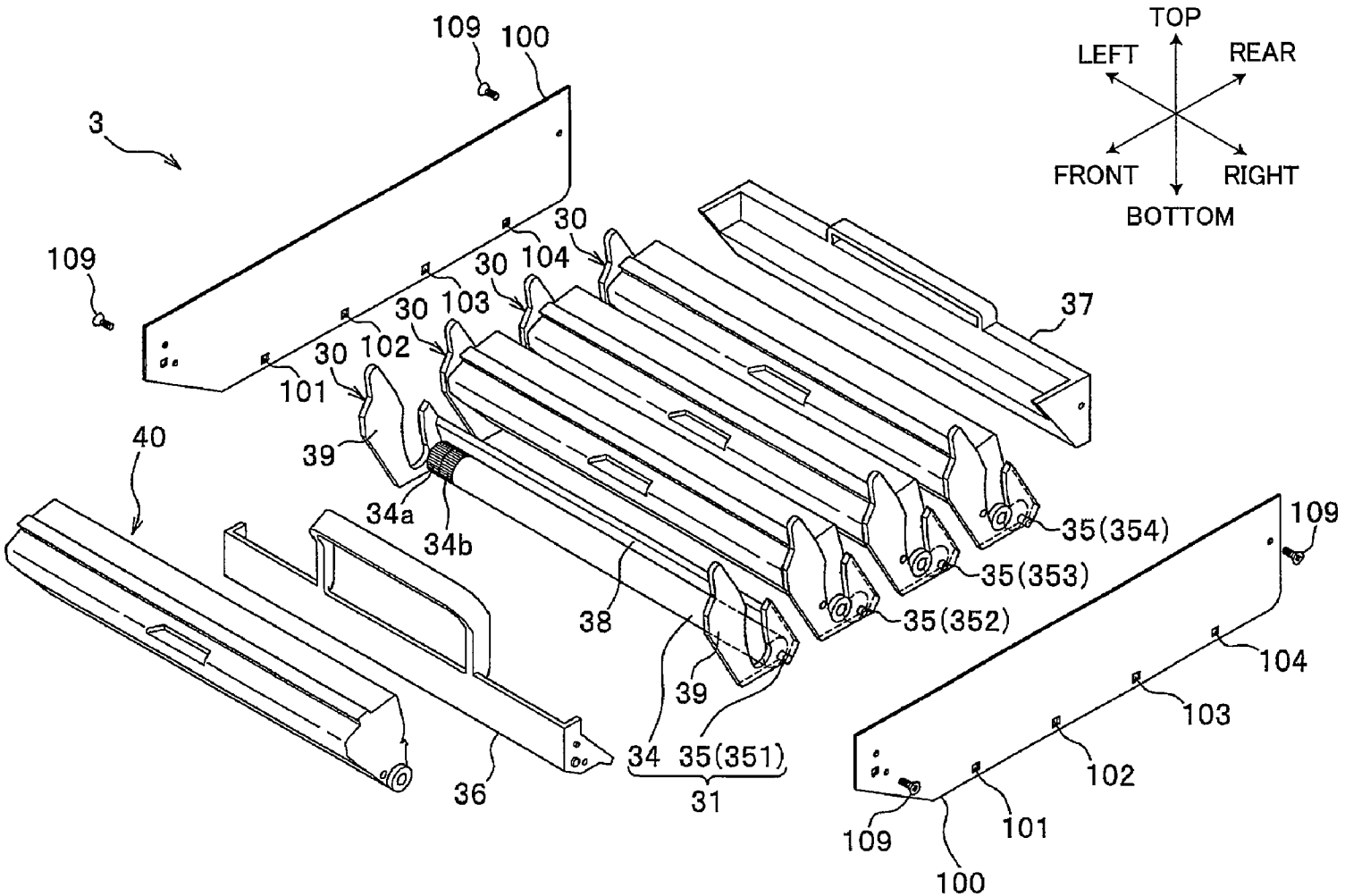
FIG. 4 is an exploded perspective view showing the photosensitive unit.

The color laser printer 1 is characterized by the positioning of the plurality of photosensitive drums 31 to one another and the positioning of the plurality of photosensitive drums 31 with respect to the main unit 2. Now, the details of the photosensitive unit 3 will be described. FIG. 4 is an exploded perspective view of the photosensitive unit 3. FIG. 4 shows a state in which the developing cartridge 40 is removed from the forefront drum sub-unit 30. As shown in FIG. 4, the photosensitive unit 3 includes four drum sub-units 30, a front beam 36, a rear beam 37 and side plates 100.

The drum sub-unit 30 includes a center frame 38, sub-side frames 39 and a photosensitive drum 31. The scorotron-type charger 32 and cleaning brush 33 is provided on the center frame 38. The sub-side frames 39 are fixed on both sides in the left-to-right directions of the center frame 38 and rotatably support the photosensitive drum 31. Each of the sub-side frames 39 is a resin member having substantial parallelogram shape. The supporting shafts 35 of the photosensitive drum 31 protrude outward from the sub-side frames 39.

The four drum sub-units 30 extend in the left-to-right direction of the main unit 2, respectively, and are arranged in the front-to-rear direction. Further, the front beam 36 is disposed on the front side of the drum sub-units 30 and a rear beam 37 on the rear side thereof. Then, these beams 36 and 37 are joined integrally with the side plates 100.

Each of the side plates 100 is a frame member formed by pressing a metallic plate. Each of the side plates 100 is formed with four supporting holes 101, 102, 103 and 104 corresponding to the supporting shafts 35 (351, 352, 353 and 354) of the photosensitive drums 31. The shapes and positions of the supporting holes 101, 102, 103 and 104 will be described later in detail. The supporting holes 101, 102, 103 and 104 are formed larger than the diameters of the supporting shafts 35 to loosely insert the supporting shafts 35. Hence, the supporting shafts 35 are freely-movable in the supporting holes 101, 102, 103 and 104, respectively. A drum gear 34*a* and a transmission gear 34*b* are juxtaposed and provided on the left end of the drum main body 34. The drum gear 34*a* and transmission gear 34*b* has the substantially same diameter as the drum main body 34. The drum gear 34*a* is meshingly engaged with a drum drive gear 25 provided in the main unit 2 (see FIG. 6) to rotate the drum main body 34. The transmission gear 34*b* transmits the rotation of the drum main body 34 to the developing roller 43 of the developing cartridge 40.

The drum sub-units 30 are supported on the side plates 100 by loosely inserting the supporting shafts 35 into the supporting holes 101, 102, 103 and 104. The side plates 100 are joined to the front beam 36 and rear beam 37 by screws 109. That is, the four drum sub-units 30 are loosely inserted into the supporting holes 101, 102, 103 and 104 in the rectangular frame formed by the front beam 36 and rear beam 37 and the side plates 100. The four drum sub-units 30 are supported on the side plates 100. The developing cartridges 40 are mounted on the drum sub-units 30, respectively.

As shown in FIG. 1, the photosensitive unit 3 is mounted in the main unit 2 by pushing the photosensitive unit 3 in horizontally. Side frames 20 formed by pressing metallic plates are provided on both sides of the main unit 2. Each of the side frames 20 is formed with a positioning slit 21. Each of the positioning slits 21 extends from the front end of each of the side frames 20 along the horizontal direction (the front-to-rear direction). When mounting the photosensitive unit 3 in the main body 2, the supporting shafts 35 are inserted into the positioning slits 21.

3. Configuration for Positioning Photosensitive Drums 31

Figure 5:
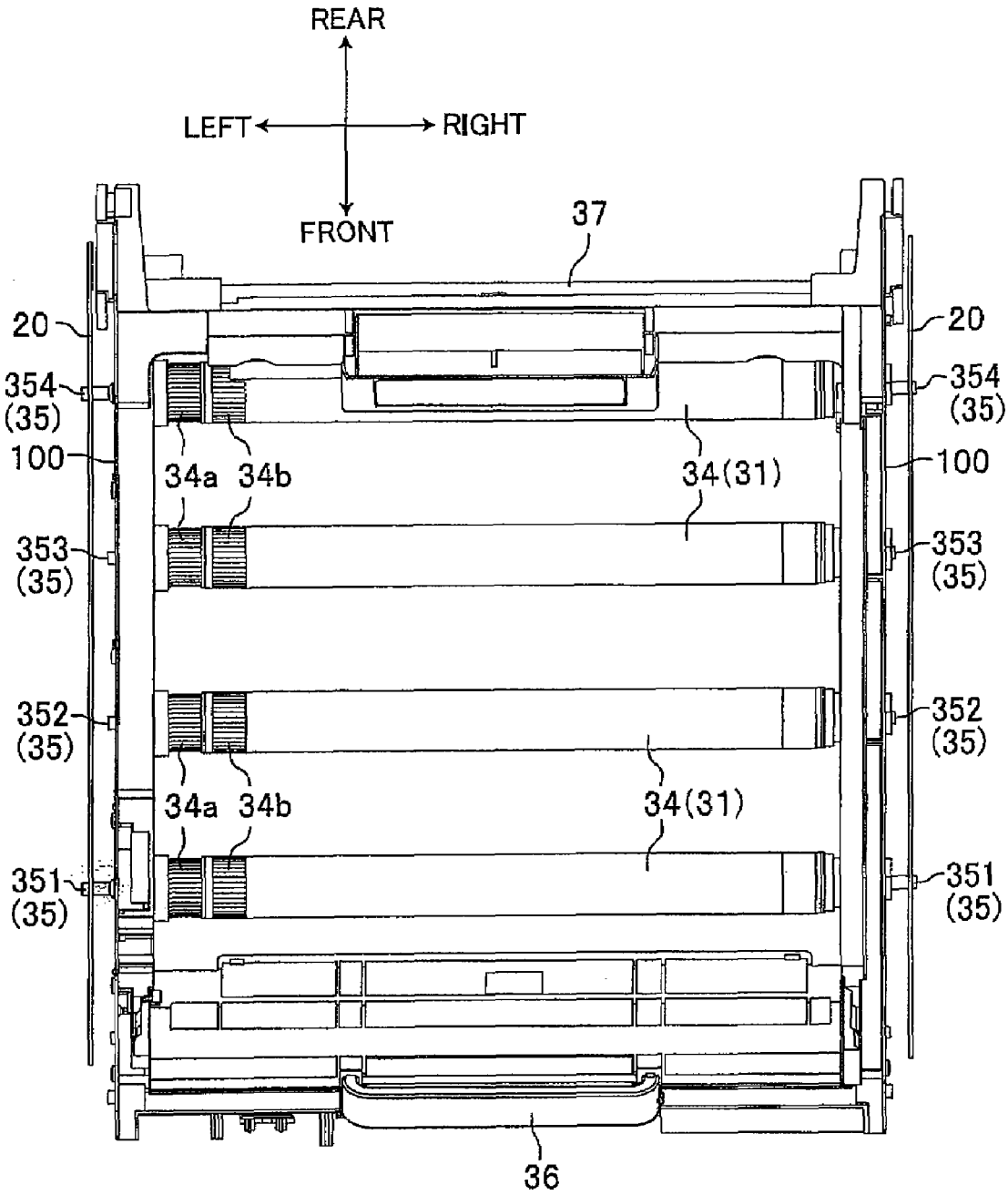
FIG. 5 is a plan view showing the positional relationship between side frames and the photosensitive unit.

FIG. 5 is a plan view showing the positional relationship between the side frames 20 and the photosensitive unit 3. In FIG. 5, the center frame 38 and developing cartridges 40 are omitted so that the photosensitive drums 31 may be visible.

As shown in FIG. 5, the supporting shafts 351 and 354 located foremost and rearmost (hereinafter, referred to as outer supporting shafts 351 and 354) are longer than the two supporting shafts 352 and 353 (hereinafter, referred to as inner supporting shafts 352 and 353) that are interposed between the outer supporting shafts 351 and 354. Hence, the outer supporting shafts 351 and 354 project outward than the inner supporting shafts 352 and 353 in the left-to-right direction. Then, only the outer supporting shafts 351 and 354 are inserted into the positioning slits 21 of the side frames 20 of the main unit 2, and the inner supporting shafts 352 and 353 are not inserted into the positioning slits 21 of the side frames 20 of the main unit 2. That is, the positional relationship between the side frames 20 and the photosensitive unit 3 is determined based on the two outer supporting shafts 351 and 354.

Figure 6:
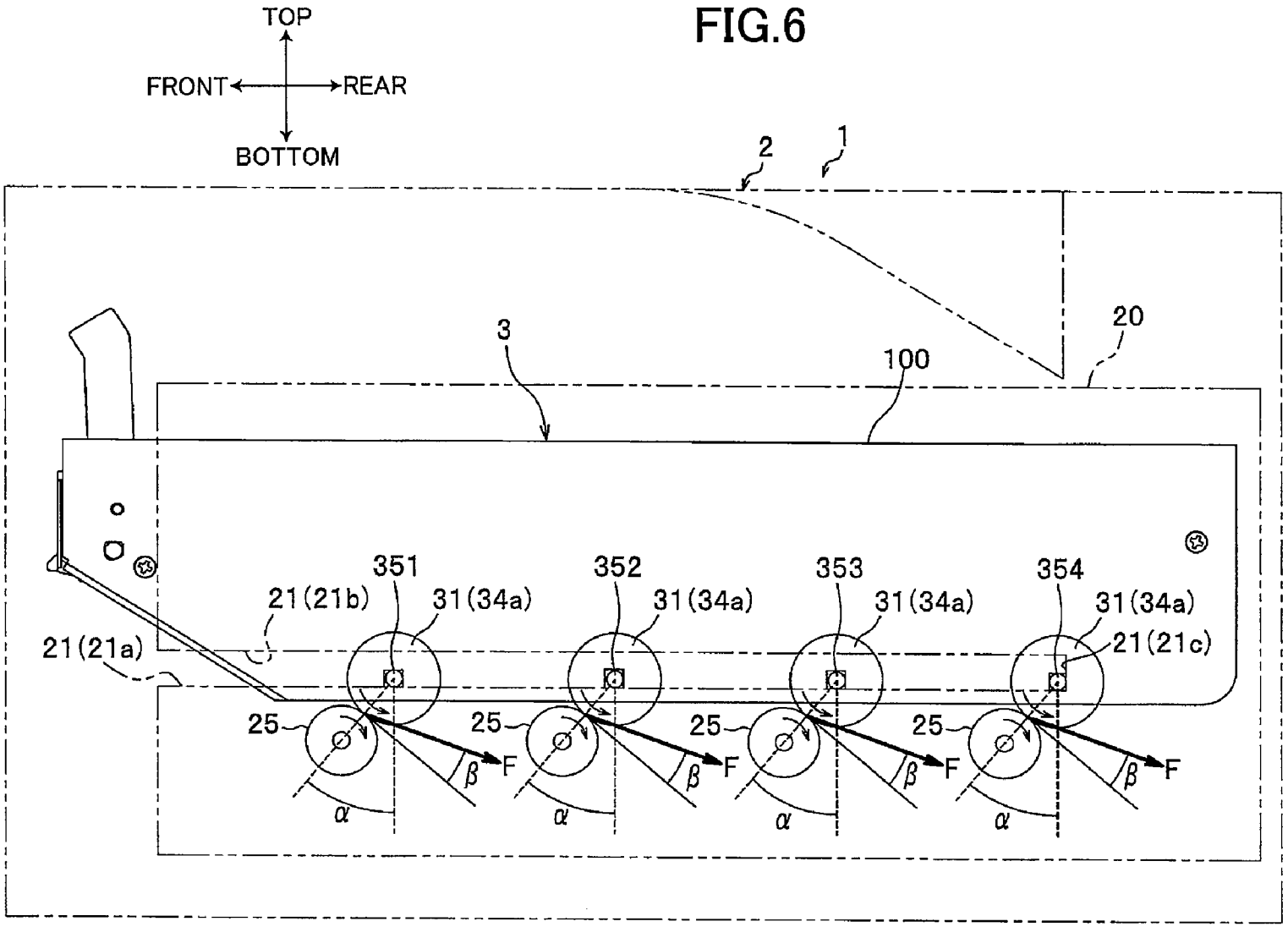
FIG. 6 is a side view showing the photosensitive unit.
Figure 7:
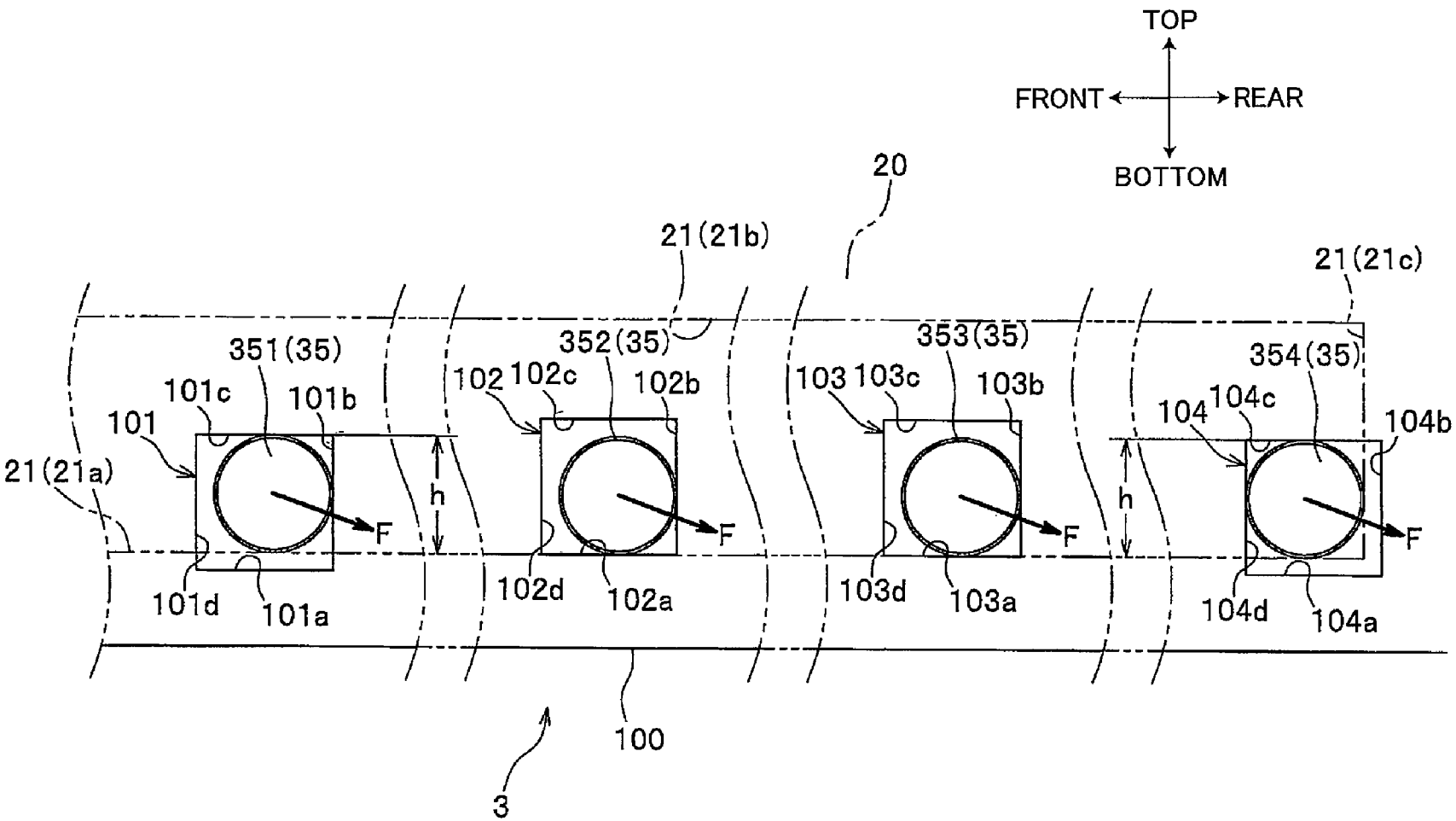
FIG. 7 is an enlarged view showing the relationship between supporting shafts and the side frames.

FIG. 6 is a side view of the photosensitive unit 3, and FIG. 7 is an enlarged view showing the relationship between the supporting shafts 351 to 354 and side frames 20. As shown in FIG. 6, the positioning slits 21 formed on the side frames 20 have openings on the front end thereof, respectively. Each of the positioning slits 21 has a horizontally extending lower edge 21*a*, a horizontally extending upper edge 21*b*, and a vertically extending side edge 21*c*. These respective edges 21*a* to 21*c* are formed linear. The side edge 21*c* faces to a direction in which the photosensitive unit 3 is pushed into main unit 2. The lower edge 21*a* and side edge 21*c* are used for positioning the photosensitive drums 31 with respect to the main unit 2. The upper edge 21*b* is not used for positioning the photosensitive drums 31 with respect to the main unit 2. In the description below, the lower edge, side edge on the rear side (rear edge), upper edge and side edge on the front side (front edge) in each of the supporting holes 101 to 104 is denoted by adding the symbols of a, b, c and d to 101 to 104, respectively. For example, as shown in FIG. 7, the edges of the supporting hole 101 are shown as a lower edge 101*a*, rear edge 101*b*, upper edge 101*c* and front edge 101*d*, respectively.

As shown in FIG. 6, the drum drive gears 25 meshingly engaged with the drum gears 34*a* are provided on the lower front side of the photosensitive drums 31, respectively. The drum drive gears 25, of which precise positions and fixing method are not shown, are provided on the main unit 2. The drum drive gears 25 are located on the front side of rotational axis of the photosensitive drums 31, respectively. Hence, a direction connecting rotational axis of each of the drum drive gears 25 and rotational axis of each of the photosensitive drums 31 to each other forms a positive angle $\alpha$ in the clockwise direction of FIG. 6 with the downward vertical direction. The angle $\alpha$ is, for example, about 40°. In such an arrangement, when the drum drive gear 25 rotates clockwise direction in FIG. 6, the drum gear 34*a* is pushed toward a direction F in a portion of the drum gear 34*a* engaging with the drum drive gear 25. When the drum drive gear 25 and the drum gear 34*a* have a generally used pressure angle of 20°, the direction F forms 20° (angle $\beta$ in FIG. 6) toward the drum gear 34*a* side (in the counterclockwise direction of FIG. 6) with the common tangent direction of pitch circles. In addition, the angle $\alpha$ is preferably 20° to 110°. With this structure, the pushing force of the drum drive gears 25 is applied to the photosensitive drum 31 in the downward direction and rearward direction (in the paper conveying direction).

As shown in FIG. 7, the four supporting holes 101 to 104 are not formed on the same level, but are displaced slightly up and down. Specifically, the upper edges 101*c* and 104*c* of the outer supporting holes 101 and 104 are located on the same level in the vertical direction, and the upper edges 102*c* and 103*c* of the inner supporting holes 102 and 103 are located higher than the upper edges 101*c* and 104*c* in the vertical direction. By contraries, the lower edges 102*a* and 103*a* of the inner supporting holes 102 and 103 are located on the same level in the vertical direction, and the lower edges 101*a* and 104*a* of the outer supporting holes 101 and 104 are located lower than the lower edges 102*a* and 103*a* in the vertical direction. Preferably, the distance h between the upper edge 101*c* of the supporting hole 101 as well as upper edge 104*c* of the supporting hole 104 and the lower edge 102*a* of the supporting hole 102 as well as lower edge 103*a* of the supporting hole 103 is identical to the diameter of the respective supporting shafts 35 (351 to 354). With this structure, the supporting shafts 35 (351 to 354) are juxtaposed horizontally on the same level, when the photosensitive unit 3 is mounted on the main unit 2.

4. Effects According to the Present Embodiment

Now, the effects of the positioning of the photosensitive drums 31 in the color laser printer 1 in the present embodiment will be described.

[Positioning of Supporting Shafts 351 and 354 in Vertical Direction]

By mounting the photosensitive unit 3 in the main unit 2, the supporting shafts 351 and 354 are positioned in the vertical direction by the weight of the photosensitive drums 31. That is, the outer supporting shafts 351 and 354 are inserted into the positioning slits 21 of the side frames 20 and therefore are supported by the side frames 20. More specifically, by bringing the lower ends of the outer supporting shafts 351 and 354 into contact with the lower edges 21*a* of the positioning slits 21, the two outer supporting shafts 351 and 354 are positioned in the vertical direction with respect to the main unit 2. That is, a position of the two outer supporting shafts 351 and 354 in the vertical direction with respect to the main unit 2 is determined.

[Positioning of Side Plates 100 in Vertical Direction]

The side plates 100 are positioned in the vertical direction with respect to the main unit 2 by the weight of the side plates 100 and two inner photosensitive drums 31. By bringing the upper edges 104*c* of the supporting holes 104 into contact with the upper end of the supporting shaft 354 and bringing the upper edges 101*c* of the supporting holes 101 into contact with the upper end of the supporting shaft 351, the side plates 100 are positioned in the vertical direction with respect to the main unit 2. In other words, the side plates 100 are positioned in the vertical direction with suspending from the two outer supporting shafts 351 and 354.

[Positioning of Supporting Shaft 354 in Horizontal Direction]

When the color laser printer 1 starts and the drum drive gears 25 begin to rotate, the supporting shafts 35 and the side plates 100 are positioned in the vertical and horizontal directions with respect to the main unit 2. As shown in FIG. 6, the rearmost photosensitive drum 31 is pushed in the downward and rearward directions by the drum drive gear 25, thereby pushing also the supporting shaft 354 in the downward and rearward directions. The pushing force of the drum drive gear 25 brings the rear end of the supporting shaft 354 into contact with the side edges 21*c* of the positioning slits 21. Hence, the supporting shaft 354 is positioned in the horizontal direction with respect to the main unit 2. That is, a position of the supporting shaft 354 in the horizontal direction with respect to the main unit 2 is determined. In addition, the rear end of the supporting shaft 354 is away from the rear edges 104*b* of the supporting holes 104.

[Positioning of Side Plates 100 in Horizontal Direction]

The two inner photosensitive drums 31 are pushed downward and rearward directions by the drum drive gears 25, thereby pushing also the supporting shafts 352 and 353 in the downward and rearward directions. Further, the supporting shafts 352 and 353 which are pushed by the pushing force of the drum drive gears 25 push the side plates 100 in the downward and rearward directions. As a result of the side plates 100 being pushed rearward, the front edges 104*d* of the supporting holes 104 come into contact with the front end of the supporting shaft 354 and the rear end of the supporting shaft 354 comes into contact with the side edges 21*c* of the positioning slits 21. Hence, the side plates 100 are positioned in the horizontal direction with respect to the main unit 2. At this time, since the side plates 100 are pushed also downward, the upper edges 101*c* and 104*c* of the supporting holes 101 and 104 remain in contact with the upper ends of the supporting shafts 351 and 354, therefore the side plates 100 don't move in the vertical direction. In addition, the lower end of the supporting shaft 351 is separated from the lower edges 101*a* of the supporting holes 101 and the lower end of the supporting shaft 354 is away from the lower edges 104*a* of the supporting holes 104.

[Positioning of Supporting Shafts 352 and 353 in Vertical Direction]

The two inner photosensitive drums 31 are pushed in the downward and rearward directions by the drum drive gears 25, thereby pushing also the supporting shafts 352 and 353 in the downward and rearward directions. By the pushing force of the drum drive gear 25 and the weight of the inner photosensitive drums 31, the inner supporting shaft 352 is pushed downward and the lower end thereof comes into contact with the lower edges 102*a* of the supporting holes 102. Hence, the supporting shaft 352 is positioned in the vertical direction with respect to the main unit 2. As with the supporting shaft 352, the inner supporting shaft 353 is pushed downward and the lower end thereof comes into contact with the lower edges 103*a* of the supporting holes 103, thereby positioning the supporting shaft 353 in the vertical direction with respect to the main unit 2. In addition, the upper end of the supporting shaft 352 is away from the upper edges 102*c* of the supporting holes 102, and the upper end of the supporting shaft 353 is away from the upper edges 103*c* of the supporting holes 103. Moreover, as stated above, since the supporting shafts 352 and 353 are shorter than the supporting shafts 351 and 354, the supporting shafts 352 and 353 are caught neither on the side frames 20, nor in the positioning slits 21.

[Positioning of Supporting Shafts 351, 352 and 353 in Horizontal Direction]

Moreover, the supporting shafts 351, 352 and 353 are pushed rearward by the pushing force of the drum drive gears 25, thereby bringing the rear end of the supporting shafts 351, 352 and 353 into contact with the rear edges 101*b*, 102*b* and 103*b* of the supporting holes 101, 102 and 103. Hence, the supporting shafts 351, 352 and 353 are positioned in the horizontal direction with respect to the main unit 2. In addition, the front ends of the supporting shafts 351, 352 and 353 are away from the front edges 101*d*, 102*d* and 103*d* of the supporting holes 101, 102 and 103, respectively.

In this manner, the supporting shafts 351 to 354 can be positioned preciously in the vertical and horizontal directions with respect to the main unit 2. Further, the plurality of photosensitive drums 31 can be positioned to one another based on the shapes of the supporting holes 101 to 104 and aligned parallel to one another. Since the supporting holes 101 to 104 are formed larger than the diameter of the supporting shafts 35 to loosely insert the supporting shafts 35, the four photosensitive drums 31 (drum sub-units 30) can be easily joined to the side plates 100 and integrally to one another. Moreover, by utilizing the pushing force of the drum drive gears 25 for driving the photosensitive drums 31, the supporting shafts 351 and 354 are brought into contact with the lower edges 21*a* of the side frames 20, the side plates 100 is brought into contact with the supporting shafts 351 and 354, and further, the supporting shafts 351, 352 and 353 are brought into contact with the rear edges 101*b*, 102*b* and 103*b* of the supporting holes 101, 102 and 103. Thus, the supporting shafts 351 to 354 can be positioned in the supporting holes 101 to 104 without providing a spring for pushing the supporting shafts 351 to 354 forcibly in one direction and by providing one side plate 100 per one side in the left-to-right direction.

Moreover, in the color laser printer 1 of the present embodiment, the two supporting shafts 351 and 354, which are located in the forefront and rearmost as well as on the uppermost and lowermost stream sides in the paper conveying direction of the recording paper 51, are supported by the lower edges 21*a* of the positioning slits 21. Thus, the main unit 2 can support the photosensitive unit 3 with having a long span in the front-to-rear direction. Accordingly, the photosensitive unit 3 can be stably supported and the error from the design value of a horizontal tilt of the photosensitive unit 3 can be reduced.

Moreover, in the color laser printer 1 of the present embodiment, the direction of the pushing force of the drum drive gears 25 (horizontal component) for the photosensitive drums 31 is the same as the paper conveying direction of the recording paper 51. Thus, the paper conveying force of the photosensitive drums 31 can be smoothly transmitted to the recording paper 51, and the supporting shafts 35 of the photosensitive drums 31 can be positioned on the main unit 2 while being moved in one direction (the rearward direction).

In the color laser printer 1 of the present embodiment, the photosensitive unit 3 is of drawer-type in which the photosensitive unit 3 is mounted in and removed from the main unit 2 by drawing and inserting operations. Thus, the supporting shaft 354 located on the rearmost side can be positioned in the horizontal direction by using the terminal portions (the side edges 21*c*) of the positioning slits 21. That is, the side edges 21*c* in which the supporting shaft 354 contacts have functions for indicating the complication of the inserting operation of the photosensitive unit 3 and for positioning the photosensitive unit 3 to the main unit 2. Accordingly, when a user confirms the completion of the insertion of the photosensitive unit 3 by contacting the supporting shaft 354 to the side edges 21*c*, the photosensitive unit 3 is concurrently positioned in the horizontal direction with certainty.

5. Modifications

The preferred embodiment of the present invention has been described above, however, the present invention is not limited to the above embodiment and can be applied with being appropriately changed as follows:

For example, in the above embodiment, the color laser printer 1 has four photosensitive drums 31. However, if the color laser printer 1 has a plurality of photosensitive drums 31, more or less than four photosensitive drums 31 may be used for the color laser printer 1. The present invention may be applied to an image forming apparatus for a color copying machine.

Moreover, in the above embodiment, the color laser printer 1 includes the drawer-type photosensitive unit 3. However, the photosensitive unit 3 may be mounted on the main unit 2 through an opening of the main unit 2. An upper cover opens to expose the opening formed in the upper side of the main unit 2.

In the above embodiment, two supporting shafts 351 and 354 in the uppermost and lowermost streams in the paper conveying direction are supported by the side frames 20 of the main unit 2, thereby positioning the two supporting shafts 351 and 354 in the vertical direction with respect to the main unit 2. However, another two supporting shafts, for example, two inner supporting shafts 352 and 353 may be supported by the side frames 20.

Figure 8A:
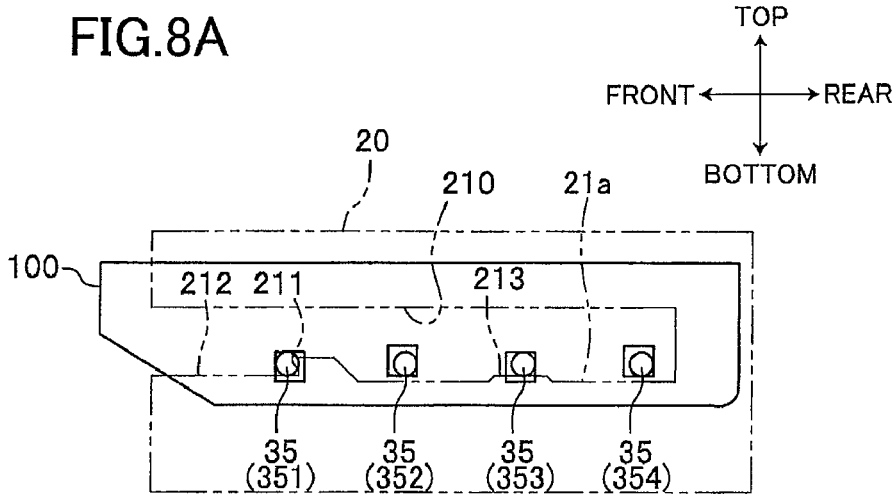
FIG. 8A is a view illustrating one variation of the side frames.

In the above embodiment, the rearmost supporting shaft 354 is brought into contact with the side edges 21*c* of the positioning slits 21 in the operation of inserting the photosensitive unit 3 into the main unit 2. However, as shown in FIG. 8A, the supporting shaft 35 other than the rearmost supporting shaft 354 may be brought into contact with the side frames 20. For example, in FIG. 8A, the foremost supporting shaft 351 may be brought into contact with horizontal positioning portions 211 formed on the lower edges 210*a* of positioning slits 210, and vertical positioning sections 212 and 213 may be provided for supporting the supporting shafts 35 (351 and 353) from below. This structure can also position the photosensitive unit 3 to the main unit 2 in the horizontal direction. However, in such this structure, a guide member for the supporting shafts 352 to 354 to go over the horizontal positioning sections 211 must be provided to mount the photosensitive unit 3 into the main unit 2. Accordingly, as described in the above embodiment, it is preferred that the rearmost supporting shaft 354 is brought into contact with the side edges 21*c* of the side frames 20 for positioning the photosensitive unit 3 to the main unit 2 in the horizontal direction.

In the above embodiment, a direction of the pushing force of the drum drive gears 25 applied to the photosensitive drums 31 has the same direction as the paper conveying direction of the recording paper 51 in the transfer unit 63. However, a direction of the pushing force of the drum drive gears 25 applied to the photosensitive drums 31 may have an opposite direction from the paper conveying direction of the recording paper 51 in the transfer unit 63. Even in this case, the photosensitive drums 31 can be positioned so as to align the photosensitive drums 31 parallel to one another. However, it is preferred that a direction of the pushing force of the drum drive gears 25 has the same direction as the paper conveying direction of the recording paper 51 in the transfer unit 63 for smoothly conveying the recording paper 51 and positioning the photosensitive drums 31.

In the above embodiment, the side frames 20 of the main unit 2 for positioning the supporting shafts 35 (351 and 354) are located outside the side plates 100 in the left-to-right direction, respectively. However, since members (for example, the side frames 20) of the main unit 2 for positioning the supporting shafts 35 need only come into contact with the supporting shafts 35, these members may be provided inside the side plates 100 in the left-to-right direction. For example, positioning plates extending between the sub-side frames 39 and side plates 100 from below may be provided. In this case, the side plates 100 may be formed with concave portions, that open inward, in place of the supporting holes 101 to 104.

Figure 8B:
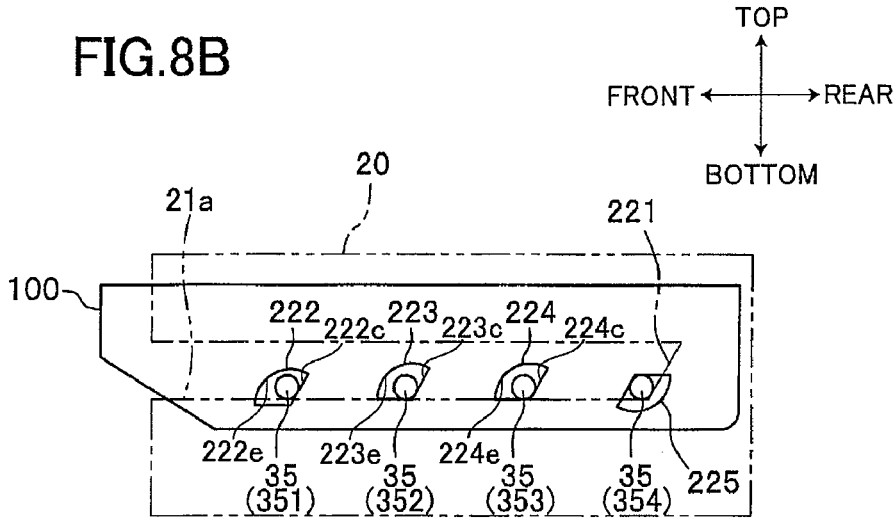
FIG. 8B is a view illustrating another variation of the side frames and supporting holes.
Figure 8C:
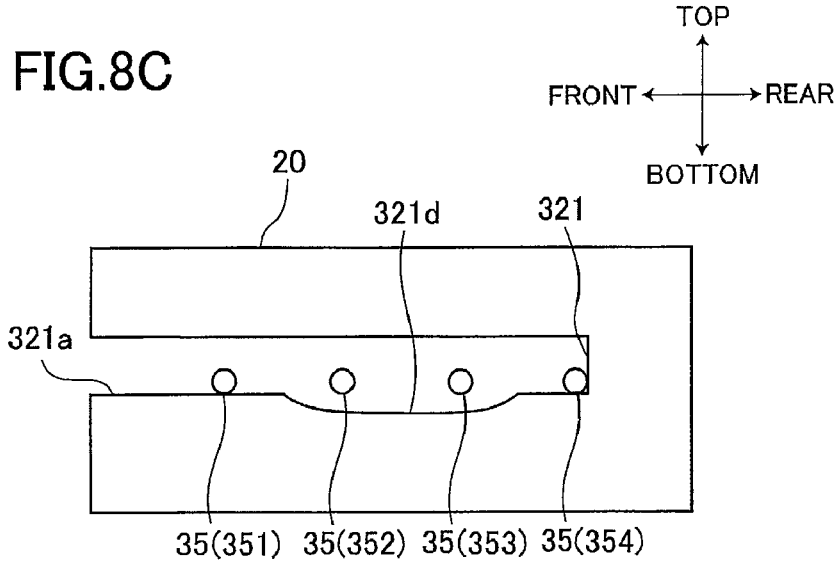
FIG. 8C is a view illustrating another variation of the side frames.

In the above embodiment, the supporting holes 101 to 104 are squared-shape holes of which the upper edges 101*c* to 104*c*, the lower edges 101*a* to 104*a* and the side edges 101*b* to 104*b* and 101*d* to 104*d* extend the horizontal and vertical directions, respectively. However, the supporting holes 101 to 104 need only have edge portions for stopping the supporting shafts 35 in the vertical and horizontal directions and are not limited to the squared-shaped holes that formed by edge portions extending the horizontal and vertical direction. The same can be applied to the lower edges 21*a* and side edges 21*c* of the side frames 20 of the main unit 2. For example, as shown in FIG. 8B, side edges 221 at the rear end of positioning slit 21 may be inclined with respect to the vertical direction. Further, the side edges 222*c* to 224*c* of supporting holes 222 to 225 may be inclined with respect to the vertical direction and portions 222*e* to 224*e*, which are away from the supporting shafts 35, of the supporting holes 222 to 225 may be formed in an arc-shaped. Therefore, each of the supporting holes 222 to 225 is formed in a fan-like form. Moreover, the lower edges 21*a* of the positioning slits 21 may be inclined with respect to the horizontal direction. Further, in the present embodiment, the positioning slits 21 formed in the side frames 20 are simply horizontally extending linear slits, and therefore, the inner supporting shafts 352 and 353 are formed shorter than the outer supporting shafts 352 and 354. However, as shown in FIG. 8C, if a concave portion 321*d* that opens upward is formed on a portion, where the inner supporting shafts 352 and 353 are positioned, of the lower edge 321*a*, the inner supporting shafts 352 and 353 may be as long as the outer supporting shafts 351 and 354. Further, in the above embodiment, the side frames 20 are formed with the positioning slits 21 on which the supporting shafts 35 lay. However, the side frames 20 may be provided with a rail-like member on which the supporting shafts 35 lay.

What is claimed is:

1. An image forming apparatus comprising:

an outer frame;

a photosensitive unit disposed in the outer frame, the photosensitive unit comprising:

a plurality of photosensitive drums, each of the plurality of photosensitive drums having an axis extending in a first direction, one axial end and another axial end, the plurality of photosensitive drums being juxtaposed in a second direction perpendicular to the first direction;

a first supporting shaft provided on the one axial end of each of the plurality of photosensitive drums;

a second supporting shaft provided on the another axial end of each of the plurality of photosensitive drums, the first support shaft and the second support shaft rotatably supporting each of the plurality of photosensitive drums; and a drum gear provided on the one axial end of each of the plurality of photosensitive drums and rotatable together with each of the plurality of photosensitive drums, a drum drive gear rotatably supported on the outer frame and meshingly engaged with the drum gear to rotate the drum gear, the drum drive gear being configured to apply a pushing force to the drum gear, the photosensitive drum, the first supporting shaft and the second supporting shaft in the second direction when the drum drive gear drives the drum gear;

a first positioning portion provided in the outer frame, the first supporting shaft and the second supporting shaft provided on one of the plurality of photosensitive drums being brought into contact with the first positioning portion by the pushing force, a position of the first supporting shaft and the second supporting shaft provided on the one of the plurality of photosensitive drums in the second direction with respect to the outer frame being determined by contacting the first supporting shaft and the second supporting shaft to the first positioning portion; and a second positioning portion provided in the outer frame and supporting two of the first supporting shafts and two of the second supporting shafts provided on two of the plurality of the photosensitive drums, a position of the two of the first supporting shafts and the two of the second supporting shafts in a third direction perpendicular to both the first direction and the second direction with respect to the outer frame being determined by supporting the two of the first supporting shafts and the two of the second supporting shafts on the second supporting portion.

2. The image forming apparatus according to claim 1, wherein the two of the plurality of photosensitive drums are located on both ends of the plurality of photosensitive drums in the second direction, respectively.

3. The image forming apparatus according to claim 2, wherein the photosensitive unit further comprises a first side plate disposed on one side of the plurality of photosensitive drums and formed with a plurality of first supporting holes to loosely insert the first supporting shafts, and a second side plate disposed on another side of the plurality of photosensitive drums and formed with a plurality of second supporting holes to loosely insert the second supporting shafts.

4. The image forming apparatus according to claim 3, wherein each of the plurality of first supporting holes is defined by a first upper edge and a first lower edge and each of the plurality of second supporting holes is defined by a second upper edge and a second lower edge, and wherein the first upper edges of the first supporting holes located on both ends of the plurality of the first supporting holes are located lower than the first upper edges of the plurality of the first supporting holes other than the both ends of the plurality of the first supporting holes, and the second upper edges of the second supporting holes located on both ends of the plurality of the second supporting holes in the second direction are located lower than the second upper edges of the plurality of the second supporting holes other than the both ends of the plurality of the second supporting holes.

5. The image forming apparatus according to claim 3, wherein the each of the plurality of first supporting holes is defined by a first upper edge and a first lower edge and each of the plurality of second supporting holes is defined by a second upper edge and a second lower edge, and wherein the first lower edges of the first supporting holes located on both ends of the plurality of the first supporting holes are located lower than the first lower edges of the plurality of the first supporting holes other than the both ends of the plurality of the first supporting holes, and the second lower edges of the second supporting holes located on both ends of the plurality of the second supporting holes in the second direction are located lower than the second lower edges of the plurality of the second supporting holes other than the both ends of the plurality of the second supporting holes.

6. The image forming apparatus according to claim 3, wherein the plurality of first supporting holes and the plurality of second supporting holes are formed squared-shape.

7. The image forming apparatus according to claim 1, wherein each of the drum gears is rotatable about a first rotational axis and each of the drum drive gear is rotatable about a second rotational axis, the first rotational axis being in parallel with the second rotational axis, wherein a line perpendicular to both the first rotational axis and the second rotational axis is inclined by an angle $\alpha$ with respect to the third direction, the angle $\alpha$ being in a range of $20° < \alpha < 110°$.

8. The image forming apparatus according to claim 1, wherein the photosensitive unit is mountable to the outer frame by inserting operations of the photosensitive unit in the second direction and removable from the outer frame by drawing operations of the photosensitive unit in a direction opposite the second direction.

9. The image forming apparatus according to claim 1, wherein the first positioning portion comprises first and second positioning sections located in a spaced-apart relation, the first supporting shaft being brought into contact with the first positioning section, the second supporting shaft being brought into contact with the second positioning section, wherein the second positioning portion comprises first and second positioning sections, the first positioning section of the second positioning portion supporting the two of first supporting shafts, the second positioning section of the second positioning portion supporting the two of second supporting shafts.

10. The image forming apparatus according to claim 9, further comprising a first side frame and a second side frame, the photosensitive unit being interposed between the first side frame and the second side frame, wherein the first side frame is formed with one slit that opens at an end thereof and is formed to extend in the second direction, the first side frame having the first positioning section of the first positioning portion and the first positioning section of the second positioning portion, the first positioning section of the first positioning portion and the first positioning section of the second positioning portion forming the one slit, and wherein the second side frame is formed with another slit that opens at an end thereof and is formed to extend in the second direction, the second side frame having the second positioning section of the first positioning portion and the second positioning section of the second positioning portion, the second positioning section of the first positioning portion and the second positioning section of the second positioning portion forming the another slit.

* * * * *